US006465377B2

(12) United States Patent
Andriaensen et al.

(10) Patent No.: US 6,465,377 B2
(45) Date of Patent: Oct. 15, 2002

(54) CANVASS REINFORCEMENT

(75) Inventors: Ludo Andriaensen; Gerard Vandewalle, both of Deerlijk (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 09/445,030

(22) PCT Filed: May 8, 1998

(86) PCT No.: PCT/EP98/02980

§ 371 (c)(1),
(2), (4) Date: Dec. 3, 1999

(87) PCT Pub. No.: WO98/55682

PCT Pub. Date: Dec. 10, 1998

(65) Prior Publication Data

US 2002/0136870 A1 Sep. 26, 2002

(30) Foreign Application Priority Data

Jun. 6, 1997 (EP) ..... 97201715

(51) Int. Cl.[7] ..... D03D 9/00; B32B 5/10; B32B 27/04; B32B 27/14

(52) U.S. Cl. ..... 442/6; 442/43; 442/52; 442/58; 428/198; 428/297.4; 428/298.1; 428/357; 428/379

(58) Field of Search ..... 428/198, 297.4, 428/298.1, 357, 379; 442/6, 43, 52, 58

(56) References Cited

U.S. PATENT DOCUMENTS 3,674,139 A * 7/1972 Manasian et al. ..... 206/83.5
4,216,856 A * 8/1980 Moring et al. ..... 198/874
5,045,377 A * 9/1991 Amata ..... 428/107
5,062,161 A * 11/1991 Sutton ..... 2/169
5,172,647 A * 12/1992 Towne ..... 114/103
5,213,874 A 5/1993 Prudhomme
5,512,380 A * 4/1996 De Vos et al. ..... 428/592
5,656,167 A * 8/1997 Martz ..... 210/490
6,065,518 A * 5/2000 Miyawaki et al. ..... 152/454
6,247,298 B1 * 1/2001 Bourgois et al. ..... 57/902

FOREIGN PATENT DOCUMENTS

EP 0 174 792 3/1986
EP 0 441 719 A1 8/1991

* cited by examiner

*Primary Examiner*—Terrel Morris
*Assistant Examiner*—Victor Chang
(74) *Attorney, Agent, or Firm*—Foley & Lardner

(57) ABSTRACT

A fabric for reinforcement of canvasses having a plastic coating includes a warp and a weft which form meshes. The meshes have a maximum dimension ranging from 5 cm to 30 cm with at least one of the warp or the weft being formed by a strip which comprises a matrix of a thermoplastic material which is adherable to the plastic coating of the canvasses. The strip includes two or more elongated metal members and has a cross-sectional average thickness ranging from 0.50 mm to 3.0 mm and a cross-sectional width ranging from 3 mm to 25 mm. The metal members provide the canvasses sufficient resistance against the cutting action of a knife or against the action of a pair of shears.

20 Claims, 2 Drawing Sheets

CANVASS REINFORCEMENT

FIELD OF THE INVENTION

The present invention relates to a fabric and to a strip for reinforcement of canvasses having a plastic coating.

BACKGROUND OF THE INVENTION

Canvasses or sail clothes having a plastic coating, e.g. on a textile tissue, are used as tent material and as material to cover and protect the cargo or loads on vehicles or containers. A number of requirements are put on these canvasses.

A first requirement that the canvasses must give a sufficient protection against vandalism and robbery. Here it is postulated that a proper canvass should at least delay the action of an opportunist thief who acts by means of a knife or cutter or by means of a pair of shears. The delay should last a number of minutes.

A second requirement is that canvasses must prevent the load from uncontrolled horizontal movements without tearing.

A third requirement is that initial cracks in canvasses must be prevented from growing.

A fourth requirement is that canvasses together with their reinforcement must have a weight which is as low as possible.

The prior art has already provided a solution which meets three of the above-mentioned requirements. Such a prior art canvass is reinforced by means of a woven fabric of stainless steel wires or cords.

Following drawbacks, however, are discovered with such prior art canvasses.

First of all such canvasses are very expensive due to the high price of the stainless steel fabric and to the expensive way of manufacturing such a canvass.

Secondly, the stainless steel fabric increases the weight of the canvass to an unacceptable degree so that the above-mentioned fourth requirement is not met.

And thirdly, the stainless steel fabric negatively influences the appearance or outlook of the canvass and as a result any publicity or brand names are no longer clearly pronounced on the canvass. Aramid reinforcements may provide a solution to the first and third drawback but remain expensive and they do not give a sufficient resistance against the action of a cutter or a knife.

SUMMARY OF THE INVENTION

It is a general object of the present invention to avoid the drawbacks of the prior art.

It is a first object of the present invention to provide for a low-cost reinforcement for canvasses.

It is a second object of the present invention to provide for a reinforcement for canvasses with an acceptable weight.

It is a third object of the present invention to provide for a reinforcement of canvasses which minimizes the influences on the appearance or outlook of canvasses.

According to one aspect of the present invention there is provided a fabric for reinforcement of canvasses having a plastic coating. The fabric comprises a warp and a weft which form meshes. These meshes have a maximum dimension ranging from 5 cm to 30 cm, preferably from 5 cm to 25 cm. Most preferably this maximum dimension is adapted to the kind of goods to be protected, but the most suitable dimension of these meshes is preferably about 7 cm to 15 cm, for example about 8 cm to 12 cm, in order to slow down the action of a thief which tries to penetrate his fist into such a mesh in order to take away goods. At least one of the warp or the weft (but preferably both the warp and the weft) is (are) formed by a strip which comprises a matrix of a thermoplastic material which is adherable to the plastic coating of the canvasses.

The strip further comprises two or more elongated metal members, preferably located parallel in the plane of the strip, in order to provide sufficient resistance against the cutting action of a knife or against the action of a pair of shears. The plurality of elongated metal members give to the strip the required strength and simultaneously enable the strip to remain thin and flexible. The strip has a cross-section with at least one flat side and an average thickness ranging from 0.50 mm to 3.0 mm, preferably ranging from 0.50 mm to 2.00 mm, and a cross-sectional width ranging from 3 mm to 25 mm, e.g. ranging from 5 mm to 25 mm. This flat cross-section enables the strip to remain thin whilst simultaneously providing a sufficient surface for adhesion between the canvass and the fabric.

The strips forming the warp may be connected to the strips forming the weft by means of an adhesive or by means of a welding technique where it is not necessary that the elongated metal members are welded to each other: it is sufficient that the connection is made by means of the thermoplastic material alone. The welding or at least contacting of one or more metal members of the warp to one or more metal members of the weft is, however, not excluded. This has the drawback that the welding is more expensive, but has the advantages that the final fabric is much stronger and that the fabric can be used as electrical circuits which may provide additional security.

According to one embodiment of the fabric the strips forming the weft lie above the strips forming the warp (or vice versa). Adhering such a fabric to a canvass leads to a canvass which is relatively flexible in the direction of the strips (warp or weft) that are adhered to the canvass over their complete length and relatively stiff in the direction of the strips (weft or warp) that are not adhered to the canvass at the points of crossing with the other strips.

According to another embodiment of the fabric the strips forming the weft lie alternatingly under and above the strips forming the warp. Adhering such a fabric to a canvass leads to a canvass which is equally flexible in both the warp and weft direction.

The functionality and flexibility of a fabric may also be influenced by the type of metal members used to reinforce the strips. High carbon steel cords (carbon content above 0.7%) have the advantage of being relatively flexible, of having a high strength and of adhering mechanically well to the matrix material of the strip due to their undulated outer surface. They provide a good remedy against the action of a knife or a cutter. The steel cord may have a high elongation at break, e.g. an elongation at break exceeding 5%, so that much energy can be absorbed before the steel cord breaks. In a particular embodiment of the invention the steel cord has two or more twist angles which differ substantially from each other.

Substantially differing twisting angles has the advantage of offering an improved resistance against stabs. Preferably the steel cord is free of residual torsions and of other tensions in order to avoid that the steel cord would become wild when the strip is welded under heat to the canvass.

The inventors have experienced, however, that metal members which are more ductile than high carbon steel cords provide an improved resistance against the action of a pair of shears or a pair of scissors and that this resistance is even increased if the ductile member does not adhere to the matrix material. Examples of ductile members are a copper wire, which has the advantage of being very suitable for use in an electrical circuit or a low carbon steel wire (carbon content below 0.4%) which can be thermally treated to further increase its ductility. The steel wire can be a round steel wire or a flat steel wire. In comparison with steel cords, the wires have a much smoother surface and adhere mechanically not so well to the matrix material. With respect to the resistance against the action of a pair of shears, this has been experienced more as an advantage than as a drawback. The copper or steel wires are, however, less flexible than steel cords but for equal strengths a steel wire is less expensive but less flexible.

Canvasses for trucks may be divided into two main categories: canvasses of the curtain type and canvasses of the roll up type. Canvasses of the curtain type are slidingly suspended on horizontal rails and can be horizontally slid to one side to open the canvass. Canvasses of the curtain type require flexibility in the horizontal direction. Canvasses of the roll up type can be rolled up vertically to open the canvass. Canvasses of the roll up type require a flexibility in the vertical direction. Fabrics according to the invention may be realized so that there are strips reinforced with flexible metal members such as steel cords in one direction (the horizontal for canvasses of the curtain type and the vertical for canvasses of the roll up type) and strips reinforced with ductile but less flexible metal members such as metal wires in the other direction.

Various types of metal members can also be combined in a single strip so that the single strip offers both a good resistance against the action of a knife or a cutter and a good resistance against the action of a pair of shears.

According to a second aspect of the present invention, there is provided a strip for reinforcement of canvasses having a plastic coating. The strip comprises a matrix of a thermoplastic material which is adherable to the plastic coating of the canvasses. The strip further comprises two or more elongated metal members. The strip has a cross-section with at least one flat side and with an average thickness ranging from 0.50 mm to 3.0 mm (preferably to 2.0 mm) and a cross-sectional width ranging from 3 mm to 25 mm.

The thermoplastic material is preferably of the same nature or preferably has a similar composition as the plastic coating of the canvass. Canvasses are usually made of a flexible polyvinylchloride but may also be made of a flexible polypropylene or polyethylene or even of polyester.

Preferably four to twenty metal members reinforce one single strip. In order to obtain a strip which is flat and remains flat, single-twisted cords may function as metal members where a Z-twisted cord alternates with an S-twisted cord and vice versa along the width of the cross-section of the strip. The breaking load of all the metal members in one single strip is preferably higher than 2000 Newton.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
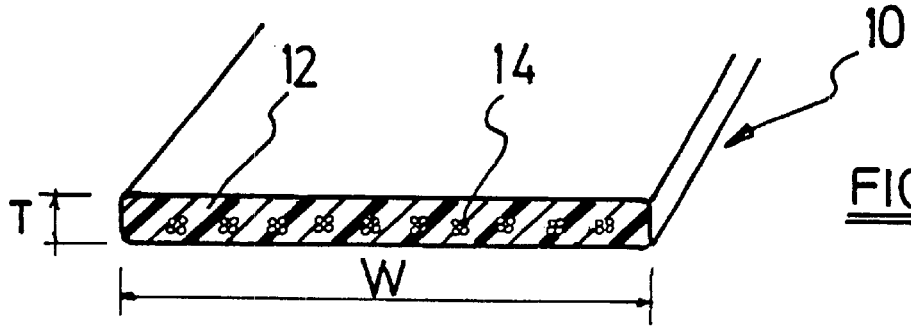
FIG. 1 and FIG. 2 show two strips according to the second aspect of the present invention.

FIG. 1 shows a strip 10 according to the second aspect of the present invention. The strip 10 comprises polyvinylchloride as matrix material 12 and ten parallel steel cords 14 of the type 4×0.175, i.e. a steel cord consisting of four filaments with each a diameter of 0.175 mm. The twisting pitch of the steel cord is 10 mm. The width W of the strip is equal to 9.0 mm and the thickness T of the strip is only 0.80 mm.

The outer left and the outer right steel cords 14 can be omitted in order to have sufficient matrix material left at the edges after the welding of the strips to each other. Otherwise the outer left and outer right metal members could come free, i.e. no longer surrounded by matrix material after the welding operation.

Obviously other type of steel cords may also be used such as a 2×0.30, a 3×0.20, a 3×0.25, a (2+2)×0.175, a 5×0.150, or a 3×2×0.22 steel cord. Single metal wires such as a round steel wire with a diameter of about 0.50 mm or a flat steel wire of about 0.70 mm×0.30 mm or of about 1.90 mm×0.58 mm are also suitable as reinforcements. The steel cords are preferably free of residual torsions and of tensions. The latter may be accomplished by applying a stress-relieving treatment to the steel cord after the twisting operation.

Figure 2:
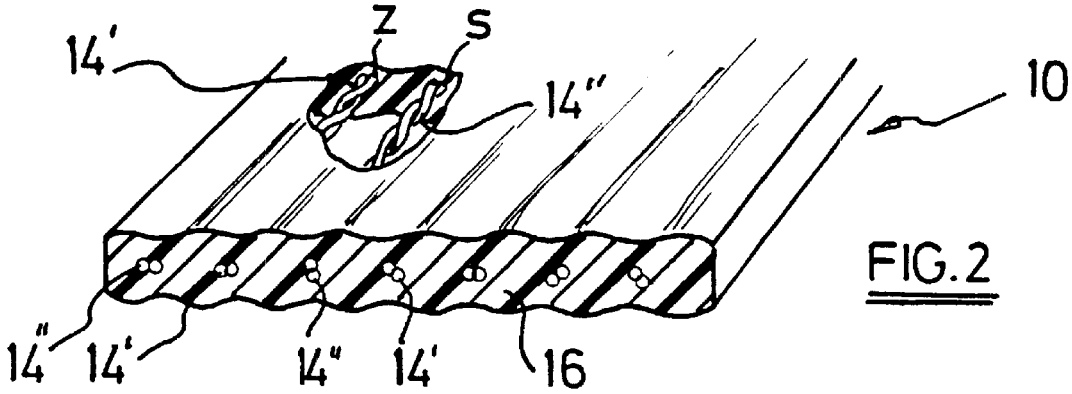

FIG. 2 shows another strip 10 which is somewhat thicker. The average thickness here is 1.20 mm and the width is 10 mm. The reinforcing cords 14' and 14" are 2×0.30 steel cords, which mean that they consist of two single filaments with a filament diameter of 0.30 mm. A Z-twisted steel cord 14' alternates with an S-twisted steel cord 14" along the width of the strip 10. A higher pressure has been applied during the extrusion of the strip, which has resulted in indentations or thickenings 16 at the level between the steel cords 14', 14". Obviously suitable tools such as dies or combs may be provided to avoids these indentations or to make indentations just at the level of the steel cords 14', 14" instead of between the steel cords 14', 14".

Figure 3:
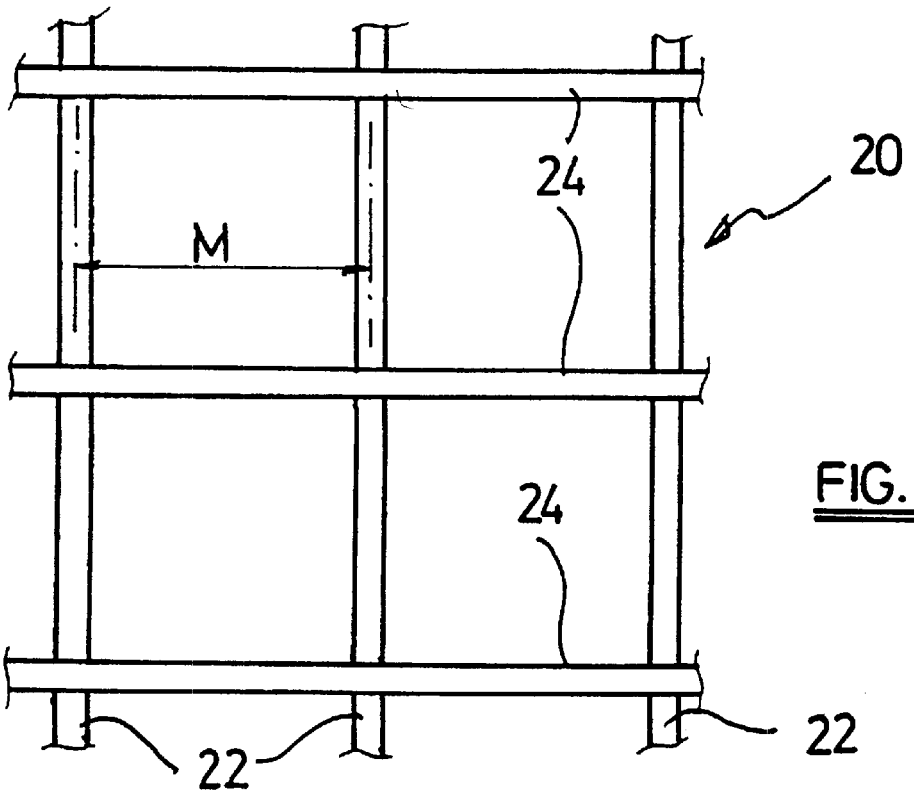
FIG. 3 and FIG. 4 show two fabrics according to the first aspect of the present invention.

FIG. 3 shows an embodiment of a fabric 20 according to the first aspect of the present invention. The fabric 20 comprises strips 22 forming the warp and strips 24 forming the weft lying above the strips 22. Strips 22 and strips 24 are welded to each other. The width M of the mesh (measured between the center lines of two adjacent parallel strips) is 10 cm. Welding strips 22 forming the warp over their whole length to a canvass so that the equally reinforced strips 24 forming the weft are only welded to the canvass for the part between the crossing points, leads to a canvass which is relatively flexible in the direction of the strips 22 forming the warp and relatively stiff in the direction of the strips 24 forming the weft. Such a reinforced canvass with a 'flexible direction' and a 'stiff direction' are suitable for reinforcement of canvasses of the curtain type and of canvasses of the roll up type.

Figure 4:
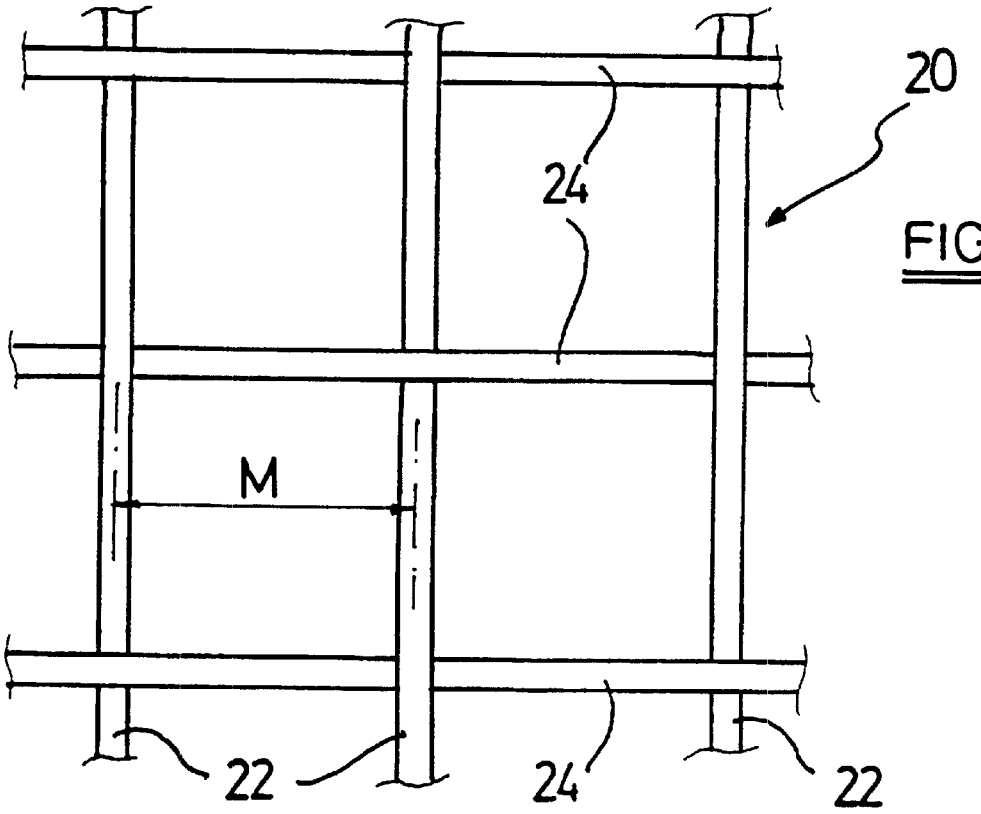

FIG. 4 shows an embodiment of a fabric 20 which provides an equal flexibility to the canvass in both directions (on condition that the strips 22 and the strips 24 are equally reinforced). This is obtained by having the strips 22 forming the warp running alternatingly over and under the strips 24 forming the weft. Such a reinforced canvass may be properly used as tent material.

Figure 5:
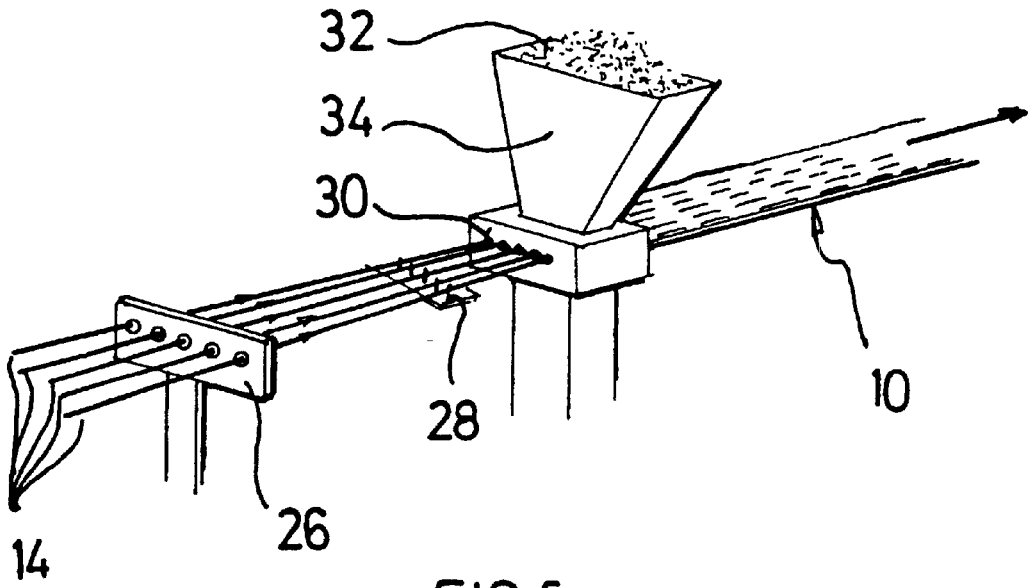
FIG. 5 schematically illustrates a way of manufacturing a strip according to the first aspect of the present invention.

FIG. 5 schematically shows a method of manufacturing a strip according to the second aspect of the present invention. Steel cords 14 are wound from spools (not shown) and led via positioning and guiding means 26 and 28 to the entrance 30 of an extrusion apparatus. The matrix material, e.g. polyvinylchloride, is provided to the extrusion apparatus in the form of granules 32 made of a compound of flexible polyvinylchloride by means of a funnel 34.

The thus extruded strips can be welded together to form a reinforcing fabric according to the first aspect of the invention. Experiments have shown that if the welding is done under pressure of 20 á 30 Pa at a temperature of 125 ° C. and during 3 minutes, that the polyvinylchloride was flowing away at the edges and that metal members could come free, i.e. no longer surrounded by polyvinylchloride. By decreasing the welding time to 1 minute, a good weld was obtained without loss of polyvinylchloride material at the edges.

In comparison with a prior art stainless steel fabric, a fabric according to the first aspect of the present invention:

a) is a low cost fabric since the composing strips can be manufactured by extrusion, and the strips can be easily adhered to each other; complex weaving can be avoided;

b) enables an easy adherence to the canvass; adherence to existing canvasses is also possible;

c) has a lower weight; as a matter of example, a fabric with a mesh width of 10 cm gives an additional weight of only 30 kg to 60 kg (depending upon the thickness and width of the strip) to a canvass for one truck;

d) does not negatively influence the appearance or outlook of a canvass if the fabric is attached to the inner side of the canvass; the outer side of the canvass can still be painted in any color or be provided with any publicity.

What is claimed is:

1. A fabric for reinforcement of canvasses having a plastic coating, said fabric comprising a warp and a weft which form meshes, said meshes having a dimension ranging from 5 cm to 30 cm, at least one of the warp or the weft being formned by a strip which comprises a matrix of a thermoplastic material which is adherable to the plastic coating of the canvasses, said strip further comprising two or more elongated metal members, said strip having a cross-sectional average thickness ranging from 0.50 mm to 3.0 mm and a cross-sectional width ranging from 3 mm to 25 mm, said metal members providing the canvasses with effective resistance against cutting action of a knife or against action of a pair of shears.

2. A fabric according to claim 1 wherein both the warp and the weft are formed by said strip.

3. A fabric according to claim 1, wherein the strips forming the weft lie above the strips forming the warp or vice versa.

4. A fabric according to claim 1 wherein the strips forming the weft lie alternatingly under and above the strips forming the warp.

5. A fabric according to claim 1 wherein the strips forming the weft each comprise two or more elongated round metal members and the strips forming the warp each comprise an elongated flat metal member.

6. A strip for reinforcement of canvasses having a plastic coating, said strip comprising a matrix of a thermoplastic material which is adherable to the plastic coating of the canvasses, said strip further comprising two or more elongated metal members, said strip having a cross-sectional average thickness ranging from 0.50 mm to 3.0 mm and a cross-sectional width ranging from 5 mm to 25 mm, said metal members providing the canvasses with effective resistance against cutting action of a knife or against action of a pair of shears.

7. A strip according to claim 6 wherein said thermoplastic material is polyvinylchloride.

8. A strip according to claim 6 wherein said thermoplastic material is a flexible polyvinylchloride compound.

9. A strip according to claim 6, wherein said metal member is a steel cord.

10. A strip according to claim 9 wherein said steel cord has an elongation at break of at least 5%.

11. A strip according to claim 9 wherein said steel cord is a single-twisted steel cord and wherein a Z-twisted steel cord alternates with an S-twisted steel cord along the width of the cross-section of the strip.

12. A strip according to claim 9 wherein said steel cord is free of residual torsions.

13. A strip according to claim 6 wherein the breaking load of all said metal members is at least 2000 Newton.

14. A strip according to claim 6 wherein said metal member is a member which is more ductile than a high carbon steel cord.

15. A strip according to claim 14 wherein said ductile member is a copper wire or a copper cord.

16. A strip according to claim 14 wherein said ductile member is a low carbon steel wire.

17. A strip according to claim 6 wherein said strip has a transversal cross-section which exhibits indentations at the level between the metal members.

18. A strip according to claim 6 wherein the number of metal members ranges from 4 to 20.

19. A canvass comprising a plastic coating and a fabric, said fabric comprising a warp and a weft which form meshes, said meshes having a dimension ranging from 5 cm to 30 cm, at least one of the warp or the weft being formned by a strip which comprises a matrix of a thermoplastic material which is adherable to the plastic coating of the canvasses, said strip further comprising two or more elongated metal members, said strip having a cross-sectional average thickness ranging from 0.50 mm to 3.0 mm and a cross-sectional width ranging from 3 mm to 25 mm, said metal members providing the canvass with effective resistance against cutting action of a knife or against action of a pair of shears.

20. A canvass comprising a plastic coating and strips, said strip comprising a matrix of a thermoplastic material which is adherable to the plastic coating of the canvasses, said strip further comprising two or more elongated metal members, said strip having a cross-sectional average thickness ranging from 0.50 mm to 3.0 mm and a cross-sectional width ranging from 5 mm to 25 mm, said metal members providing the canvass with effective resistance against cutting action of a knife or against action of a pair of shears.

* * * * *